US011478721B2

(12) United States Patent
Von Heland

(10) Patent No.: US 11,478,721 B2
(45) Date of Patent: Oct. 25, 2022

(54) DISC SHAPED THROWING OBJECT

(71) Applicant: Waboba AB, Stockholm (SE)

(72) Inventor: Axel Von Heland, Stockholm (SE)

(73) Assignee: Waboba AB, Stockholm (SE)

( * ) Notice: Subject to any disclaimer, the term of this patent is extended or adjusted under 35 U.S.C. 154(b) by 0 days.

(21) Appl. No.: 17/272,820

(22) PCT Filed: Oct. 4, 2018

(86) PCT No.: PCT/SE2018/051020
§ 371 (c)(1),
(2) Date: Mar. 2, 2021

(87) PCT Pub. No.: WO2020/071973
PCT Pub. Date: Apr. 9, 2020

(65) Prior Publication Data

US 2021/0308597 A1 Oct. 7, 2021

(51) Int. Cl.
*A63H 33/18* (2006.01)

(52) U.S. Cl.
CPC ..... *A63H 33/18* (2013.01)

(58) Field of Classification Search
CPC ..... A63H 33/18
USPC ..... 446/46; 473/588
See application file for complete search history.

(56) References Cited

U.S. PATENT DOCUMENTS 3,710,505 A * 1/1973 Linenfelser ..... A63H 33/18 473/588
3,724,122 A * 4/1973 Gillespie, Sr. ..... A63H 33/18 473/588
4,023,805 A * 5/1977 Sherrill ..... A63H 33/18 473/588
4,205,484 A * 6/1980 Kovac ..... A63H 33/18 446/46
4,315,629 A * 2/1982 English ..... A63H 33/18 473/589

(Continued)

FOREIGN PATENT DOCUMENTS

CN 2414818 Y 1/2001
CN 2649139 Y 10/2004
CN 202620727 U 12/2012

OTHER PUBLICATIONS

International Search Report PCT/ISA/210 for International Application No. PCT/SE2018/051020 dated May 27, 2019.

(Continued)

*Primary Examiner* — Alexander R Niconovich
(74) *Attorney, Agent, or Firm* — Harness, Dickey & Pierce, P.L.C.

(57) ABSTRACT

A throwing object comprises an air cushion section joined to a rim. The rim comprises an inner surface and a sequence of curved contour sections where the inner surface of the rim is at one end joined to an inner surface of the air cushion section and at a second end is joined to an outer surface of the air cushion section via the contour sections. The contour sections interconnect the inner surface with the outer surface via a first extreme radius placed at a maximum horizontal distance from the inner surface, the inner surface has a first curvature and a last contour section in the sequence together with at least a part of the outer surface has a second, different curvature.

18 Claims, 4 Drawing Sheets

(56) References Cited

U.S. PATENT DOCUMENTS

| | | | | |
|---|---|---|---|---|
| 4,334,385 | A * | 6/1982 | Melin | A63H 33/18 473/588 |
| 4,568,297 | A * | 2/1986 | Dunipace | A63H 33/18 D21/443 |
| 4,919,083 | A * | 4/1990 | Axelrod | A01K 15/025 473/588 |
| 5,078,637 | A * | 1/1992 | McFarland | A63H 33/18 473/588 |
| 5,531,624 | A * | 7/1996 | Dunipace | A63B 65/10 473/588 |
| 5,540,610 | A * | 7/1996 | Sneddon | A63H 33/18 446/236 |
| 6,179,737 | B1 * | 1/2001 | Adler | A63B 65/10 473/588 |
| 6,383,052 | B1 * | 5/2002 | McCarthy | A63H 33/18 446/153 |
| 6,840,836 | B1 * | 1/2005 | Siverson | A63H 33/18 264/328.17 |
| 6,887,119 | B2 * | 5/2005 | Bloeme | A63H 33/18 446/46 |
| 7,096,826 | B2 * | 8/2006 | Markham | A01K 15/025 119/707 |
| 7,294,036 | B2 * | 11/2007 | Potts | A63H 33/18 473/588 |
| 7,500,900 | B2 * | 3/2009 | Wolfe, Jr. | A63H 33/18 446/460 |
| 9,731,216 | B2 * | 8/2017 | Richardson | A63H 33/18 |
| 10,328,357 | B2 * | 6/2019 | Tarng | A63H 33/18 |
| 10,881,978 | B2 * | 1/2021 | Miller | A63H 33/18 |
| 2006/0030425 | A1 | 2/2006 | Sukman | |
| 2007/0207883 | A1 * | 9/2007 | Kenner | A63B 65/10 473/588 |
| 2012/0322336 | A1 * | 12/2012 | Richardson | A63H 33/18 446/46 |
| 2015/0375076 | A1 * | 12/2015 | Mayer, II | A63B 67/14 473/588 |
| 2016/0354707 | A1 * | 12/2016 | Polk | A01K 15/025 |

OTHER PUBLICATIONS

Written Opinion of the International Searching Authority PCT/ISA/237 for International Application No. PCT/SE2018/051020 dated May 27, 2019.

International Preliminary Report on Patentability dated Mar. 23. 2021 issued in PCT/SE2018/051020.

CA Office Action dated Feb. 23, 2022 in Chinese Application No. 2018800982904.

* cited by examiner

DISC SHAPED THROWING OBJECT

CROSS-REFERENCE TO RELATED APPLICATIONS

This application is a national phase under 35 U.S.C. § 371 of PCT International Application No. PCT/SE2018/051020 which has an International filing date of Oct. 4, 2018, the entire contents of each of which are hereby incorporated by reference.

TECHNICAL FIELD

The invention relates to a disc shaped throwing object.

BACKGROUND

Disc shaped throwing objects such as Frisbees™ are popular to use for recreational purposes.

There exist a variety of such disc shaped flying objects of which one is shown in CN 2649139 Y. Here the thickness of the disc from a central part to an arc-shaped edge or rim gradually changes from small to large. The disc is soft and has good safety as well as flight performance.

Other discs are known through U.S. Pat. Nos. 5,531,624 and 4,568,297.

It is of interest to make a disc be able to stay long in the air. It is also of interest to allow the rim of the disc to be held firmly for improving the precision of a throw. It is also of interest to improve aerodynamic properties in the air such as avoiding wobbling. It may also be of interest that the object is soft for instance in order to be folded or avoiding causing injuries.

SUMMARY

The present invention addresses one or more of the above-mentioned problems.

One aspect of the invention is concerned with a disc shaped throwing object having a central axis defined through a disc centre. The object comprises a first air cushion section joined to a rim. The rim in turn comprises an inner surface radially displaced from the central axis and a sequence of curved contour sections. The inner surface of the rim is at one end joined to an inner surface of the first air cushion section and at a second end to an outer surface of the first air cushion section via the contour sections, where the contour sections interconnect the inner surface of the rim with the outer surface of the first air cushion section via a first extreme radius placed at a maximum horizontal distance from the inner surface of the rim. The inner surface of the first air cushion section has a first curvature and a last contour section in the sequence together with at least a part of the outer surface of the first air cushion section has a second, different curvature. The curvatures cause the thickness of the first air cushion section to decrease towards the central axis.

In a first variation of the aspect, the first curvature is an exponential curvature starting from a starting radius on the inner surface of the rim and the second curvature is a parabolic curvature starting from the first extreme radius.

It is in this case furthermore possible that the first curvature is formed as an exponential curve so that radial position changes on the first curvature starting from the starting radius on the inner surface of the rim are exponential for changes along the central axis in a direction towards an outer surface of the disc centre and that the second curvature is formed as a second degree polynomial curve, so that radial position changes on the second curvature starting from the first extreme radius are parabolic in the direction along the central axis towards the outer surface of the disc centre.

It is in the above-mentioned case also possible that the starting radius on the inner surface of the rim is axially aligned with the first extreme radius.

According to another variation of the aspect it is possible that the rim comprises a second extreme radius placed at a maximum distance along the central axis from the outer surface of the disc centre.

The second extreme radius is thus no radius that is closest to or furthest away from the central axis, but a radius of the object that is axially furthest away from the outer surface of the disc centre.

It is possible that the first extreme radius is placed closer to an axially highest radius of the rim than it is to the second extreme radius, where the axially highest radius of the rim may be the rim radius that is axially closest to the outer surface of the disc centre.

It is additionally possible that the second extreme radius is radially closer to the inner surface of the rim than it is to the first extreme radius.

The contour sections may comprise a first curved contour section stretching from the inner surface of the rim to the second extreme radius, a second curved contour section stretching from the second extreme radius to an intermediate radius between the inner surface of the rim and the first extreme radius, a third curved contour section stretching from the intermediate radius to the first extreme radius and a fourth curved contour section that is the last curved contour section of the sequence.

In this case it is additionally possible that the first and second curved contour sections are parabolic starting from the second extreme radius so that axial position changes on these curvatures starting from the second extreme radius are parabolic for radial changes away from the second extreme radius. It is also possible that the third and fourth curved contour sections are parabolic starting from the first extreme radius so that radial position changes on these curvatures starting from the first extreme radius are parabolic for axial changes away from the first extreme radius. The curvatures of the first, second, third and fourth curved contour sections may for instance be curvatures with shapes as second-degree polynomial curves.

The rim may thereby also have an essentially ear shaped cross-section.

It is furthermore possible that the curvature of the second curved contour section gradually transitions into the curvature of the third curved contour section around the intermediate radius.

According to another possible variation, the curvature of the second contour section is the same as the curvature of the first curved contour section in the vicinity of the second extreme radius and the curvature of the third contour section is the same as the curvature of the fourth contour section in the vicinity of the first extreme radius.

It is furthermore possible that the throwing object comprises a second air cushion section forming a central section of the object having a centre point that is the disc centre of the object. In this case the first air cushion section forms a bridging section between the central section and the rim. The central section may additionally have a first radius in relation to the central axis. It is additionally possible that the central section has a uniform thickness.

In this case it is possible that the diameter of the object is at least 10 times bigger than the radius of the central section, and with advantage in the range 20-30 times bigger.

In case there is such a central section, it is additionally or instead possible that the first air cushion section forming the bridging section has an inner radius coinciding with the radius of the central section at which it is joined to the central section and an outer radius at which it is joined to the rim, wherein the outer radius is in the range 8-14 times the inner radius.

Another possibility is that the width of the rim in the radial direction, i.e. between first extreme radius and the inner surface of the rim, is in the range 4-8 mm.

Another possibility is that the thickness at the centre point of the object is in the range of 0.3-0.5 mm. This means that when there is a central section, this central section may have a thickness in the range of 0.3-0.5 mm.

Yet another possibility is that the object has a thickness in the range of 10-14 mm. This thickness may be the thickness at the centre point when also the rim is considered.

The object may additionally be a flexible object.

If the object is flexible it may be made of a material that is an elastomer, such as silicone, rubber, a thermoplastic elastomer (TPE) or a thermoplastic rubber (TPR).

When the object is flexible it may additionally or instead have a Shore D hardness of 40-70, preferably of 55-65.

The invention has a number of advantages. It allows the simultaneous reaching of several different objectives. Through the use of two different curvatures it is possible to design one for obtaining one objective and the other for another objective. The first curvature may for instance be designed for making the air cushion sections as thin as possible in order to reduce weight and allow the object to stay longer in the air. The second curvature can instead be used for improving the aerodynamic properties such as avoiding wobbling in the air.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated.

BRIEF DESCRIPTION OF THE DRAWINGS

The invention is now described, by way of example, with reference to the accompanying drawings, in which.

DETAILED DESCRIPTION

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout the description.

Figure 1:
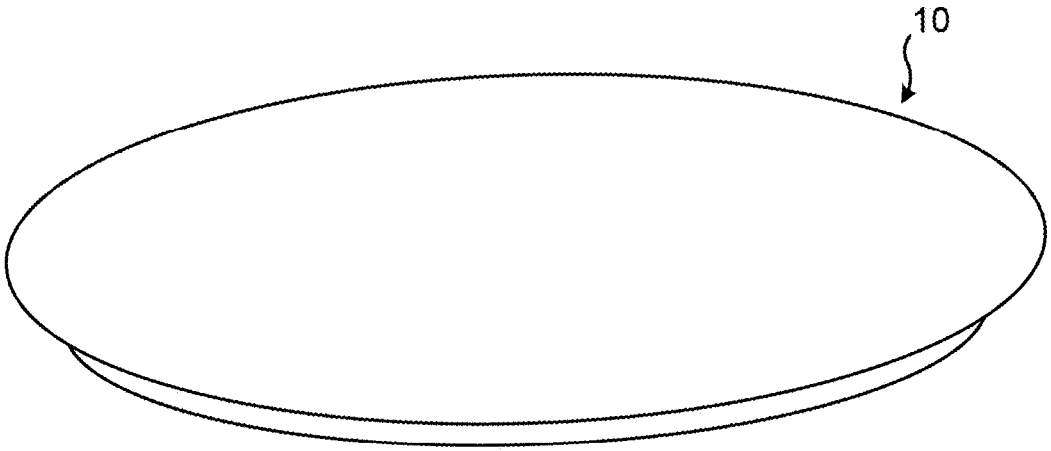
FIG. 1 shows a perspective view from above of a disc shaped throwing object.
Figure 2:
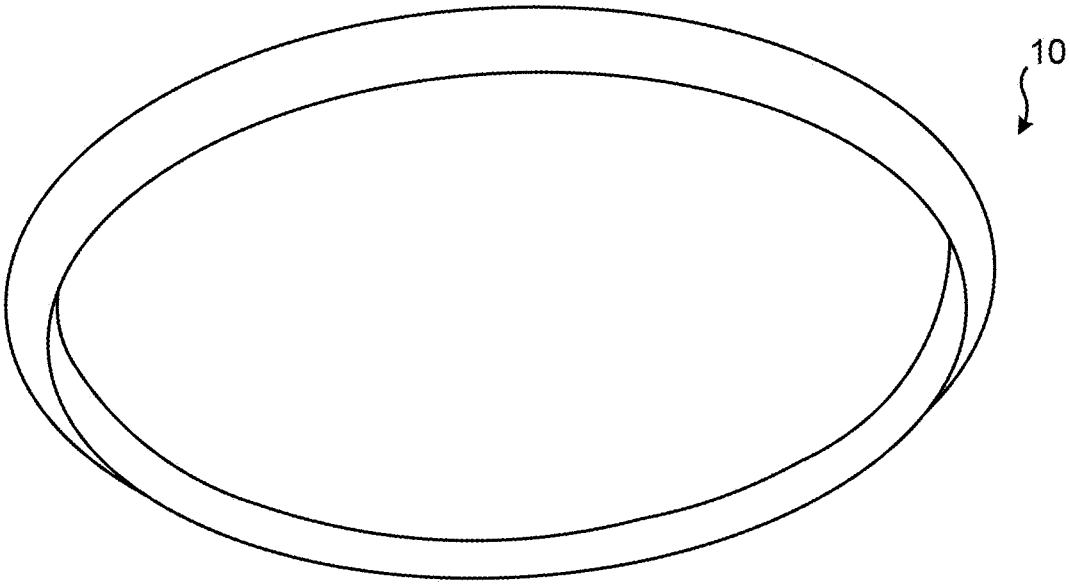
FIG. 2 shows a perspective view from below of the disc shaped throwing object.
Figure 3:
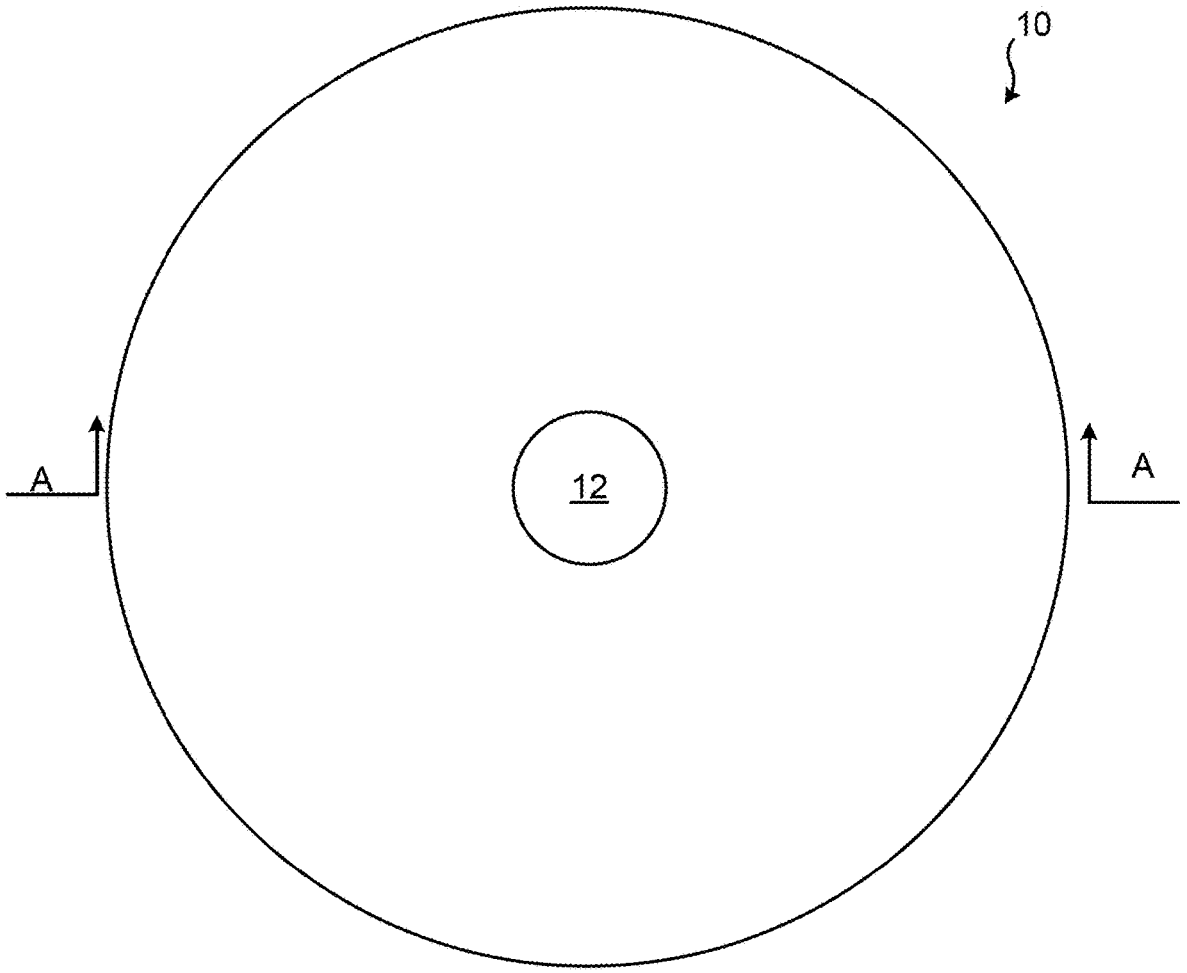
FIG. 3 shows a top view of the disc shaped throwing object with indications of where a cross-section is taken.
Figure 4:
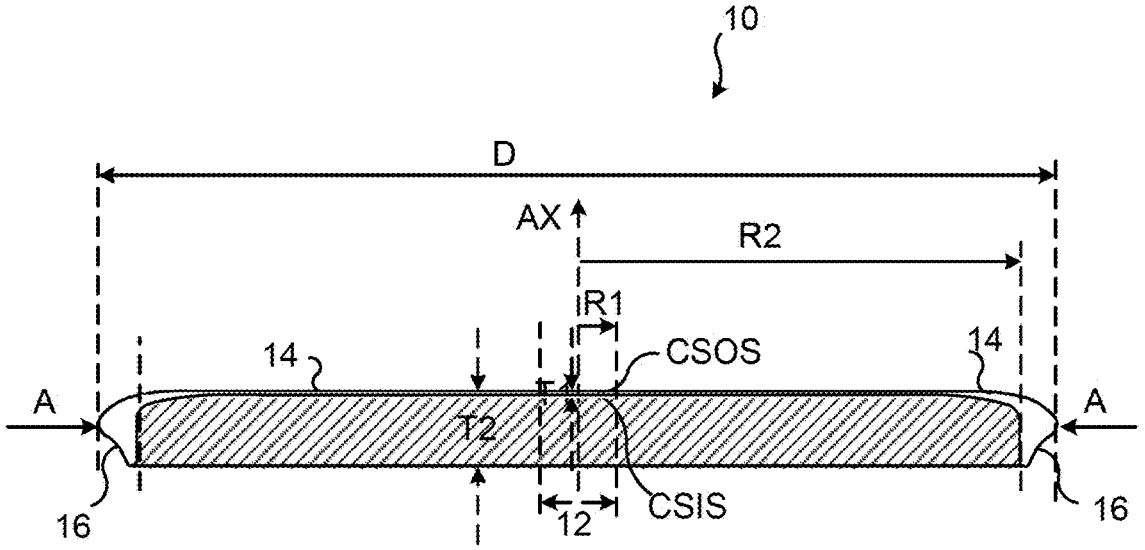
FIG. 4 shows a cross-sectional view of the object taken at the cross-section indicated in FIG. 3.
Figure 5:
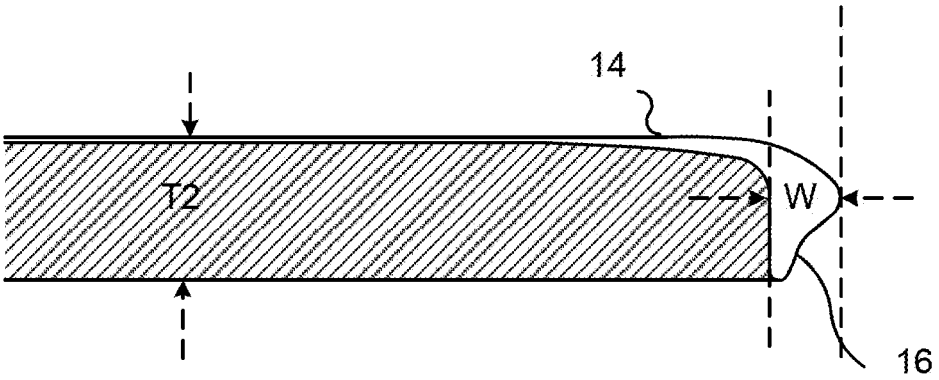
FIG. 5 shows a first enlargement of a part of the cross-section showing a rim and parts of a bridging section.
Figure 6:
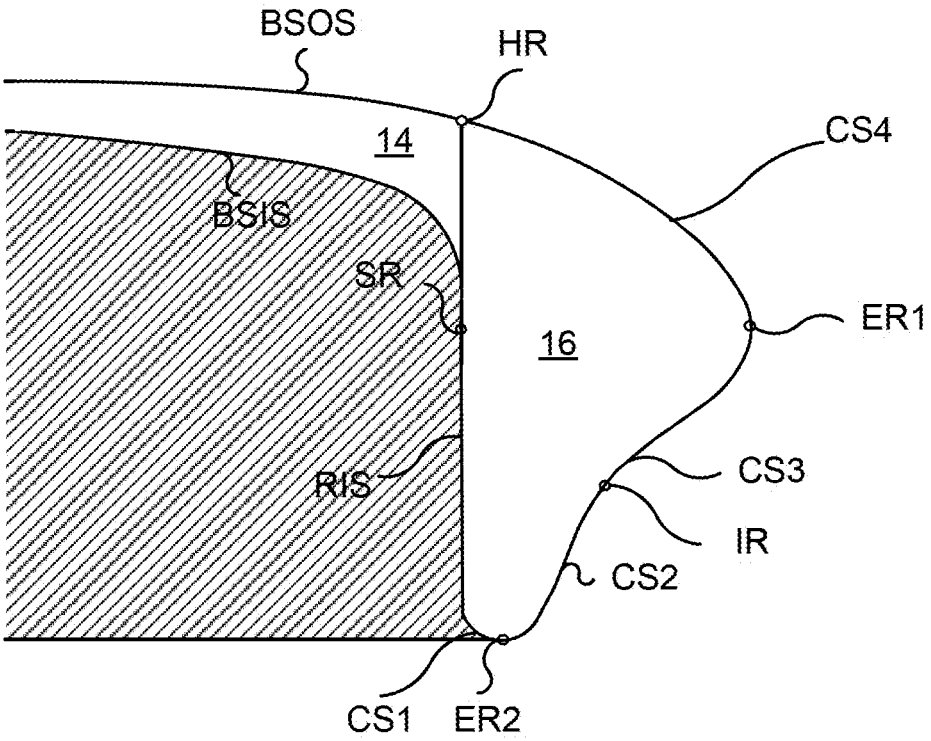
FIG. 6 shows a second enlargement with further details of the rim and bridging section.

FIG. 1 schematically shows a perspective view from above of a disc shaped throwing object 10, FIG. 2 schematically shows a perspective view from below of the disc shaped throwing object 10, FIG. 3 schematically shows a front view of the disc shaped throwing object 10 together with an indication A-A of where a cross-sectional view has been taken, FIG. 4 shows the cross-sectional view of the object taken at the cross-section A-A indicated in FIG. 3, FIG. 5 shows a first enlargement of a part of the cross-section showing a rim and parts of a bridging section and FIG. 6 shows a second enlargement with further details of the rim and bridging section.

As can be seen in the above mentioned figures the throwing object 10 is disc shaped. As can be best been in FIG. 4, the object comprises a central section 12 joined to a rim 16 via a bridging section 14. It can thereby also be seen that the bridging section 14 is joined to the rim 16. The bridging section 14 is here a first air cushion section and the central section is a second air cushion section. The sections are termed this way since in use both of them are supposed to be lifted by an air cushion.

The central section 12 is cylindrical and may have a uniform thickness T1 corresponding to the height of the cylinder, that is furthermore solid. The thickness is in this case in the range of 0.3-0.5 mm. As the central section 12 is shaped as a cylinder, there is also defined a central axis AX through the middle, i.e. through a centre point of this central section 12, and the section has a first radius R1 in relation to the central axis AX. This centre point is also the centre point of a disc centre.

It can also be seen that the bridging section 14 has an inner radius coinciding with the first radius R1 of the central section 12 and an outer radius R2 at which it is joined to the rim 16. As can be seen in the figures this bridging section does not have a uniform thickness, but instead a thickness that increases towards the rim 16 or decreases towards the central section 12.

The rim 16 in turn has a cross-section shaped as an ear. As may be best seen in FIG. 4, the rim has an inner surface RIS at a distance from the central axis AX corresponding to the second radius R2 and, as may best be seen in FIG. 6, a sequence of curved contour sections CS1, CS2, CS3, CS4.

The inner surface RIS of the rim 16 has the same distance R2 to the central axis AX. It is thereby curved around and surrounds and faces the central axis AX. The inner surface RIS thereby surrounds a cylindrical volume with radius R2 centred around the central axis AX. Moreover, the inner surface RIS is at a first end joined to an inner surface BSIS of the bridging section 14 and at a second end is joined to an outer surface BSOS of the bridging section 14 via the contour sections CS1, CS2, CS3 and CS4 and. Thereby, the first end is also joined to a flat inner surface CSIS of the central section 12 via the inner surface BSIS of the bridging section 14 and the second end is also joined to an outer surface CSOS of the central section 12 via the contour sections CS1, CS2, CS3 and CS4 and the outer surface BSOS of the bridging section 14. The inner surface of the bridging section will in the following be termed bridging section inner surface, the outer surface of the bridging section will be termed bridging section outer surface, the inner surface of the central section will be termed central section inner surface and the outer surface of the central section will be termed central section outer surface. Finally the inner surface of the rim will be termed the rim inner surface.

Moreover, the contour sections CS1, CS2, CS3 and CS4 interconnect the rim inner surface RIS with the bridging section outer surface BSOS via a first extreme radius ER1 placed at a maximum radial distance from the rim inner surface RIS. The first extreme radius ER1 can thereby be considered to be an edge in the contour of the rim 16.

Moreover, the bridging section inner surface BSIS has a first curvature and the last contour section C4 in the sequence of contour sections together with at least a part of the bridging section outer surface BSOS has a second, different curvature, where the combination of these curvatures cause the thickness of the bridging section 14 to decrease towards the disc centre, which in this case is also towards the central section 12. Through having two curvatures in this way it is possible to optimize different aspects of the flying object independently of each other. The first curvature may as an example be designed in order to decrease very rapidly from the rim 16 towards the central section 12 in the neighbourhood of the rim and thereafter to decrease slowly, which may be important if the weight of the throwing object 10 is to be lowered. At the same time the second curvature can be designed for other purposes, such as in order to achieve various aerodynamic goals.

One way in which two such curvatures are obtained in the figures will now be described.

Figure 7A:
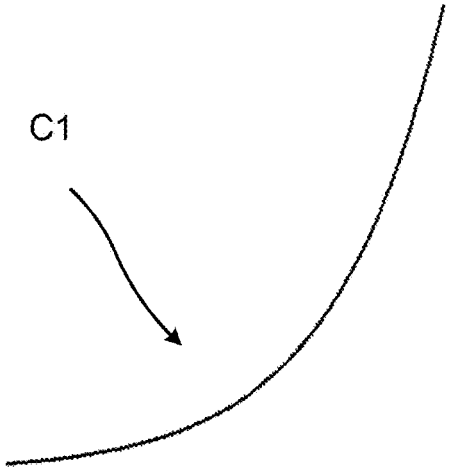
FIG. 7*a* shows an exponential curve.
Figure 7B:
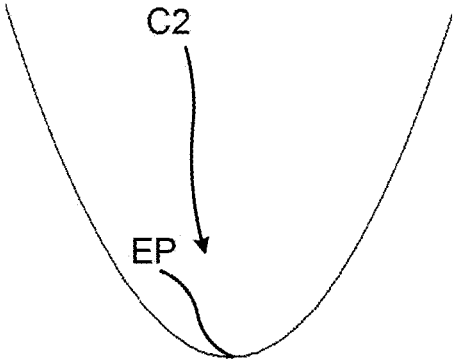
FIG. 7*b* shows a parabolic curve.
Figure 8:
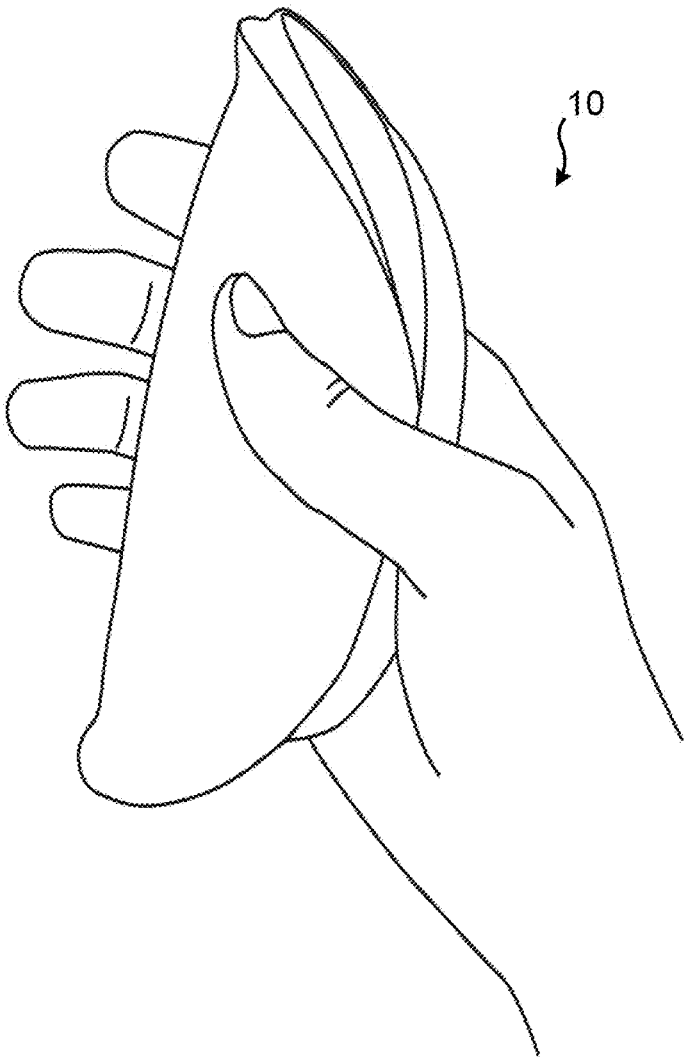
FIG. 8 shows the object being folded in the hand of a user.

One example of a first curve C1 that is an exponential curve and that may be employed for forming the first curvature is shown in FIG. 7*a*. One example of a second curve C2 that is a second-degree polynomial curve that may be employed for forming the second curvature is shown in FIG. 7*b*. This second curve has an extreme point ES which is a minimum.

According to the variation of the invention shown in FIG. 4-6, the first curvature of the bridging section inner surface BSIS is formed as an exponential curve, such as the curve C1 in FIG. 7*a*, so that radial position changes on the first curvature starting from a starting radius on the rim inner surface RIS are exponential for changes in the direction of the central axis AX towards the outer surface of the disc centre, which in this case is also towards the central section outer surface CSOS. This means that as an the axial distance on the rim inner surface in the axial direction from the starting radius SR towards the central section outer radius, the radial distance to the central axis AX decreases exponentially. The radius of the bridging section inner surface BSIS thus decreases exponentially with decreasing axial distances from the starting radius towards the central section outer radius CSOS. As can be seen in FIG. 6, it is additionally possible that the starting radius SR is axially aligned with the first extreme radius ER1. They may thus be placed at essentially the same positon along the axis AX.

The second curvature may instead be formed like a second degree polynomial curve, such as the curve C2 in FIG. 7*b*, so that radial position changes on the second curvature starting from the first extreme radius ER1 are parabolic for changes in the direction along the central axis AX towards the outer surface of the disc centre, which in this case is also towards the central section outer surface CSOS. This means that as an axial distance on the surface of the last contour section CS4 and the bridging section outer surface BSOS is decreased from the first extreme radius ER1 towards the outer surface of the disc centre, which in this case is also towards the central section outer radius CSOS, the radial distance to the central axis AX decreases parabolically. The radius of the contour section CS4 and at least some parts of the bridging section outer surface BSOS thus decrease parabolically with decreasing axial distances from the first extreme radius ER1 towards the outer surface of the disc centre, which in this case is also towards the central section outer surface CSOS. The curve may thus be a parabolic curve, such as that shown in FIG. 7*b*, where the first extreme radius ER1 corresponds to an extreme point EP of such a curve C2, such as a maximum or a minimum. Moreover, the radius at which the transition from the last contour section CS4 of the rim 16 to the bridging section outer surface BSOS is made is an axially highest HR radius of the rim 16. The axially highest radius HR is thus the radius of the rim 16 that is axially closest to the outer surface of the disc centre, which in this case is also the central section outer surface CSOS.

As can be seen in FIG. 6, the rim 16 may also comprise a second extreme radius ER2. This extreme radius may be placed at a maximum distance in the direction of the central axis AX away from the outer surface of the disc centre, which in this case is also away from the central section outer surface CSOS. The radius is thus no radius that is closest to or furthest away from the central axis AX, but a radius of the object that is axially furthest away from the outer surface of the disc centre, which is here the central section outer surface CSOS.

As mentioned earlier the rim 16 comprises a sequence of contour sections. This sequence is a sequence according to which the contour sections are joined to each other. It can be seen in FIG. 6 that the sequence comprises a first curved contour section CS1, a second curved contour section CS2, a third curved contour section CS3 and a fourth curved contour section CS4, which fourth curved contour section is the last curved contour section in the sequence. Alternatively the fourth curved contour section may be considered to be the first in the sequence and the fourth to be the last.

The first curved contour section CS1 stretches from the rim inner surface RIS to the second extreme radius ER2, the second curved contour section CS2 stretches from the second extreme radius ER2 to an intermediate radius IR between the rim inner surface RIS and the first extreme radius ER1, the third curved contour section CS3 stretches from the intermediate radius IR to the first extreme radius ER1 and the fourth curved contour section stretches from the first extreme radius ER1 to the axially highest radius HR of the rim 16.

It can here be seen that the first and second curved contour sections CS1 and CS2 have curvatures shaped as second-degree polynomial curves so that axial changes on these curvatures starting from the second extreme radius ER2 are parabolic for changes in the radial direction away from the second extreme radius ER2. The axial distance from the curved contour sections CS1 and CS2 to the axially highest radius HR thereby decrease parabolically for changes in the radial direction away from the second extreme radius ER2. The curved sections may more particularly, at least initially, be curved according to the same parabolic curve. The first and second curved contour sections CS1 and CS2 may thus be shaped according to the same second-degree polynomial curve. The curve may thus be a parabolic curve, such as that shown in FIG. 7*b*, where the second extreme radius ER2 corresponds to the extreme point EP, such as a maximum or a minimum, and the first curved contour section may be shaped as a part of the curve on one side of the extreme point, while the second curved contour section may be at least partly shaped as a part of the curve on the other side of the extreme point ES.

The third and fourth curved contour sections CS3 and CS4 may likewise be formed as second-degree polynomial curves so that radial changes on these curvatures starting from the first extreme radius ES1 are parabolic for axial changes away from the first extreme radius ER1. The radial distance from the curved contour sections CS3 and CS4 to the axis AX thereby decrease parabolically for changes in the axial direction away from the first extreme radius ER1. The curved contour sections may also here, at least initially, be curved according to the same parabolic curve. The third and fourth curved contour sections CS3 and CS4 may thus be shaped according to the same second-degree polynomial curve. The curve may thus be a parabolic curve, such as that shown in FIG. 7*b*, where the first extreme radius ER1 corresponds to the extreme point EP, such as a maximum or a minimum, and the third curved contour section may be at least partly shaped as a part of the curve C2 on one side of the extreme point ES, while the fourth curved contour section may be shaped as a part of the curve on the other side of the extreme point ES.

As can also be seen in FIG. 6, the curvature of the second curved contour section CS2 may gradually transition into the curvature of the third curved contour section CS3 around the intermediate radius IR. The second curved contour section CS2 may therefore only have the same curvature as the first curved contour section CS1 in the vicinity of the second extreme radius ER2, while the third curved contour section CS3 may only have the same curvature as the fourth curved contour section CS4 in the vicinity of the first extreme radius ER1.

One other observation that can be made in FIG. 6 is that the first extreme radius ER1 is placed closer to the axially highest radius HR of the rim 16 than it is to the second extreme radius ES2. It can also be seen that the second extreme radius ER2 is radially closer to the rim inner surface RIS than it is to the first extreme radius ER1.

The diameter D of the throwing object may be at least ten times bigger than the radius R1 of the central section 12, and with advantage 20-30 times bigger. The outer radius R2 of the bridging section 14 may in turn be in the range 8-14 times bigger than the inner radius R1. The width W of the rim in the radial direction, i.e. between first extreme point ES1 and the rim inner surface RIS may be in the range 4-8 mm. The object may finally have a thickness in the range of 10-14 mm, which thickness may essentially be the thickness of the rim 14.

The throwing object realized in this way has a very thin central section 12 and a bridging section 14 that quickly becomes very thin. Thereby it is possible to make the object lightweight. This improves the ability of the object 10 to stay long in the air. Through the design of the rim 16, the object can at the same time be firmly gripped and accurately thrown. The curved contour sections of the rim also gives the object good aerodynamic properties allowing a stable flight and makes the object less inclined to wobble in the air.

The disc shaped object 10 is typically made in one piece and it is with advantage also flexible, so that it can be folded. It can thereby be easily stowed away and carried around, such as in a pocket or. It will because of this also be soft, which is good for avoiding injuries. The material of which the object is made may for this reason be an elastomer, such as silicone, Thermoplastic Elastomer (TPE), Thermoplastic Rubber (TPR) or rubber. It may additionally have a Shore D hardness of 40-70 preferably of 55-65.

A soft and thin object has another advantage. When this object is flowing in the air, central parts around the central axis, such as the central section and parts of the bridging section, will be lifted higher by an air cushion than peripheral parts, such as the parts of the bridging section close to the rim. A bulge is thereby formed around the central axis. In this way the aerodynamic properties are further enhanced.

There are a number of variations that may be made to the invention apart from those already disclosed. It is for instance possible that there is no central section with uniform thickness. In this case it is possible that the first air cushion section is no bridging sections, but instead stretches all the way to the disc centre.

The invention has mainly been described above with reference to a few embodiments. However, as is readily appreciated by a person skilled in the art, other embodiments than the ones disclosed above are equally possible within the scope of the invention, as defined by the appended patent claims.

The invention claimed is:

1. A disc shaped throwing object having a central axis defined through a disc center, the object comprising:

a first air cushion section joined to a rim, the rim comprising an inner surface radially displaced from the central axis and a sequence of curved contour sections, wherein the inner surface of the rim is at a first end joined to an inner surface of the first air cushion section and at a second end is joined to an outer surface of the first air cushion section via the sequence of curved contour sections, wherein the sequence of curved contour sections interconnect the inner surface of the rim with the outer surface of the first air cushion section via a first extreme radius placed at a maximum horizontal distance from the inner surface of the rim, wherein the inner surface of the first air cushion section has a first curvature, and a last curved contour section in the sequence of curved contour sections together with at least a part of the outer surface of the first air cushion section has a second, different curvature, said first and second curvatures causing a thickness of the first air cushion section to decrease towards the central axis, wherein the first curvature is an exponential curvature starting from a starting radius on the inner surface of the rim and the second curvature is a parabolic curvature starting from the first extreme radius, and wherein a starting portion of the first curvature that is adjacent to and starts at the starting radius has a first curvature value, a starting portion of the second curvature that is adjacent to and starts at the first extreme radius has a second curvature value, and the first curvature value is smaller than the second curvature value, wherein the starting radius is at the first end of the inner surface of the rim, and the inner surface of the rim has a uniform radial distance from the central axis, such that the inner surface of the rim defines a cylindrical volume having radius that is the uniform radial distance and which is centered around the central axis.

2. The disc shaped throwing object according to claim 1, wherein the rim comprises a second extreme radius placed at a maximum distance along the central axis from an outer surface of the disc center.

3. The disc shaped throwing object according to claim 2, wherein the first extreme radius is placed closer to an axially highest radius of the rim than to said second extreme radius, wherein the axially highest radius of the rim is a radius that is axially closest to the outer surface of the disc center.

4. The disc shaped throwing object according to claim 2, wherein the second extreme radius is radially closer to the inner surface of the rim than the second extreme radius is to the first extreme radius.

5. The disc shaped throwing object according to claim 2, wherein the sequence of curved contour sections comprise a first curved contour section stretching from the inner surface of the rim to the second extreme radius, a second curved contour section stretching from the second extreme radius to an intermediate radius between the inner surface of the rim and the first extreme radius, a third curved contour section stretching from the intermediate radius to the first extreme radius, and a fourth curved contour section that is the last curved contour section of the sequence of curved contour sections, wherein the first and second curved contour sections are parabolic starting from the second extreme radius so that axial position changes on both a curvature of the first curved contour section and a curvature of the second curved contour section starting from the second extreme radius are parabolic for radial changes away from the second extreme radius, wherein the third and fourth curved contour sections are parabolic starting from the first extreme radius so that radial position changes on both a curvature of the third curved contour section and a curvature of the fourth curved contour section starting from the first extreme radius are parabolic for axial changes away from the first extreme radius.

6. The disc shaped throwing object according to claim 5, wherein the curvature of the second curved contour section gradually transitions into the curvature of the third curved contour section around the intermediate radius.

7. The disc shaped throwing object according to claim 6, wherein the curvature of the second curved contour section is a same curvature as the curvature of the first curved contour section in a vicinity of the second extreme radius, and the curvature of the third curved contour section is a same curvature as the curvature of the fourth curved contour section in a vicinity of the first extreme radius.

8. The disc shaped throwing object according to claim 1, further comprising:

a second air cushion section forming a central section of the object having a center point that is at the disc center of the object and a first radius of the central section in relation to the central axis and being joined with the first air cushion section that forms a bridging section between the central section and the rim, wherein a diameter of the object is at least 10 times bigger than the first radius of the central section of the central section.

9. The disc shaped throwing object according to claim 8, wherein the bridging section has an inner radius coinciding with the first radius of the central section at which the bridging section is joined to the central section, and an outer radius at which the bridging section is joined to the rim, and the outer radius is in a range of 8-14 times the inner radius.

10. The disc shaped throwing object according to claim 8, wherein the diameter of the object is in a range of 20-30 times bigger than the first radius of the central section.

11. The disc shaped throwing object according to claim 1, wherein a width of the rim in a radial direction is in a range of 4-8 mm.

12. The disc shaped throwing object according to claim 1, wherein a thickness at a center point of the object is in a range of 0.3-0.5 mm.

13. The disc shaped throwing object according to claim 1, wherein the object has a thickness in a range of 10-14 mm.

14. The disc shaped throwing object according to claim 1, wherein a material of the object is an elastomer.

15. The disc shaped throwing object according to claim 14, wherein the elastomer is silicone, rubber, a thermoplastic elastomer or a thermoplastic rubber.

16. The disc shaped throwing object according to claim 1, wherein a material of the object has a Shore D hardness of 40-70.

17. The disc shaped throwing object according to claim 16, wherein the material of the object has a Shore D hardness of 55-65.

18. The disc shaped throwing object according to claim 1, wherein the starting radius is axially aligned with the first extreme radius such that the starting radius and the first extreme radius are at a same position along the central axis of the disc shaped throwing object, and the starting portions of the first and second curvatures are axially aligned and are at the same position along the central axis.

* * * * *